United States Patent [19]

Bass

[11] 4,131,182

[45] Dec. 26, 1978

[54] SPEED PATTERN GENERATOR

[75] Inventor: Jerry D. Bass, Martinez, Calif.

[73] Assignee: Westinghouse Electric Corp., Pittsburgh, Pa.

[21] Appl. No.: 827,399

[22] Filed: Aug. 24, 1977

[51] Int. Cl.[2] ..... B66B 1/30

[52] U.S. Cl. ..... 187/29 G

[58] Field of Search ..... 187/29

[56] References Cited

U.S. PATENT DOCUMENTS

| | | | |
|---|---|---|---|
| 1,930,900 | 10/1933 | Lindquist et al. | 187/29 D |
| 1,931,030 | 10/1933 | Mortensen | 187/29 G |
| 1,953,783 | 4/1934 | Stone | 187/29 G |
| 2,128,045 | 8/1938 | Hanna | 187/29 E |
| 2,228,072 | 1/1941 | Borland | 187/29 G |
| 3,921,046 | 11/1975 | Anzai et al. | 187/29 R X |

*Primary Examiner*—Robert K. Schaefer
*Assistant Examiner*—W. E. Duncanson, Jr.
*Attorney, Agent, or Firm*—D. R. Lackey

[57] ABSTRACT

A speed pattern generator for use with manually operated construction elevator car controls. Leveling and running patterns, as well as linear acceleration and deceleration patterns are provided by a pair of operational amplifiers connected to provide integrating and amplifying functions.

7 Claims, 4 Drawing Figures

SPEED PATTERN GENERATOR

BACKGROUND OF THE INVENTION

Field of the Invention

The invention relates in general to elevator systems, and more specifically to a speed pattern generator for a construction elevator car.

Description of the Prior Art

When a building is constructed having a large number of floors, a temporary elevator car is provided for men and tools for use during the construction phase. The construction elevator car may utilize an elevator drive machine which will subsequently be used in the completed building for driving a permanent elevator car. The conventional automatic elevator controls, however, including the speed pattern generator and floor selector, cannot be used during the construction phase because the apparatus which provides signals for the proper operation of these controls is in the process of being installed.

In the prior art, the construction elevator car is provided with manually operated controls, such as pushbuttons, or a car switch. These manually operated controls include positions for leveling and running speeds. An auxiliary control box with as many as twenty electromechanical relays provides a speed pattern for the drive machine in response to the manipulation of the manually operated controls. When the operator desires to move the car upwardly or downwardly, a switch is actuated, which is associated with the selected travel direction, to provide a low speed pattern for smoothly starting the car from rest, and then a second switch is actuated to provide the acceleration and maximum speed portions of the speed pattern. When the desired stopping point is approached, the operator manually selects the deceleration portion of the speed pattern, and finally the leveling speed pattern for adjusting the car position relative to the level of the stopping floor.

While the speed pattern generator for construction elevator car switch control is simple in function, since the "feedback" is provided by an operator, the prior art relay controls for providing this simple function are relatively complex and costly. Further, the acceleration and deceleration ramps in these prior art controls are not linear, as capacitors are normally utilized which provide exponential curves.

Thus, it would be desirable to provide a new and improved speed pattern generator for use with manually operated construction elevator car control, which is less complex and less costly than prior art construction elevator car controls. It would also be desirable to provide an improved speed pattern for construction elevator car use, wherein the acceleration and deceleration portions of the speed pattern are linear. Finally, these functional and cost improvements in the speed pattern generator must be accomplished without deleteriously affecting the operational safety of the system.

SUMMARY OF THE INVENTION

Briefly, the present invention is a new and improved speed pattern generator responsive to manually operated controls. The new and improved speed pattern generator utilizes a pair of solid state operational amplifiers, which may be provided by one dual operational amplifier integrated circuit chip (IC), connected to provide integrating and amplifying functions. The speed pattern generator, complete with adjustment features, may be mounted on a 2" × 3" printed circuit-board.

The integrating function provides linear acceleration and deceleration portions of the speed pattern. The amplifying function is the primary source of certain portions of the speed pattern signal, and it is also used in conjunction with the integrating function to provide other portions of the speed pattern.

BRIEF DESCRIPTION OF THE DRAWING

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENT

Figure 1:
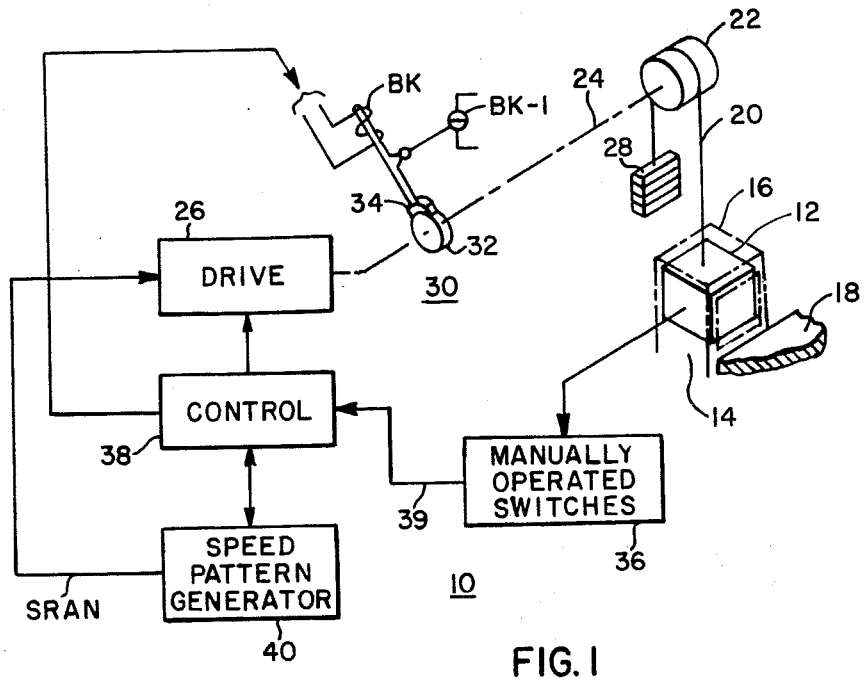
FIG. 1 is a block diagram of an elevator system which may utilize the teachings of the invention.

Referring now to the drawings, and to FIG. 1 in particular, there is shown a traction elevator system 10 which may be constructed according to the teachings of the invention. Elevator system 10 includes a temporary or construction elevator car 12. Elevator car 12 is mounted in hoistway 14 for movement relative to the floors of a building 16 which is under construction. Building 16 includes a plurality of floors or landings, such as the floor 18. Elevator car 12 is supported by a plurality of wire ropes 20 which are reeved over a traction sheave 22 mounted on the shaft 24 of a drive motor 26. The remaining ends of the ropes 20 are connected to a counterweight 28.

A brake 30 is associated with the drive machine 26. Brake 30 includes a brake drum 32, a brake shoe 34 which is spring applied to the drum 32 to hold the sheave 22 stationary, and a brake coil BK which lifts the brake shoe 34 when energized. When the brake 30 is applied, i.e., set, a switch BK-1 is closed, and when the brake 30 is lifted, switch BK-1 is opened.

The drive machine 26 may include a direct current motor and an adjustable source of direct current voltage, such as provided by a motor generator set, or by a static source, such as a dual converter.

Elevator system 10 additionally includes a plurality of manually operated switches 36 disposed in the elevator car 12. The manually operated switches 36 include a series of switches or contacts which are actuated in a predetermined sequence by an operator in the car to select the desired portions of a speed pattern signal. The manually operated switches may be those in a car switch, which are closed and opened according to the position of an operating lever; or, any other suitable type of manually operable contacts, such as pushbuttons, cam switches, control type switches, or digital logic, may be used. For purposes of example, the invention will be described relative to car switch control.

The conditions of switches 36 are communicated to basic control 38, which includes conventional safety and travel direction circuits, via a traveling cable shown generally at 39. Control 38, in response to switches 36, provides signals for a speed pattern generator 40. The speed pattern generator 40 provides a speed pattern signal SRAN for the drive machine 26.

Figure 2:
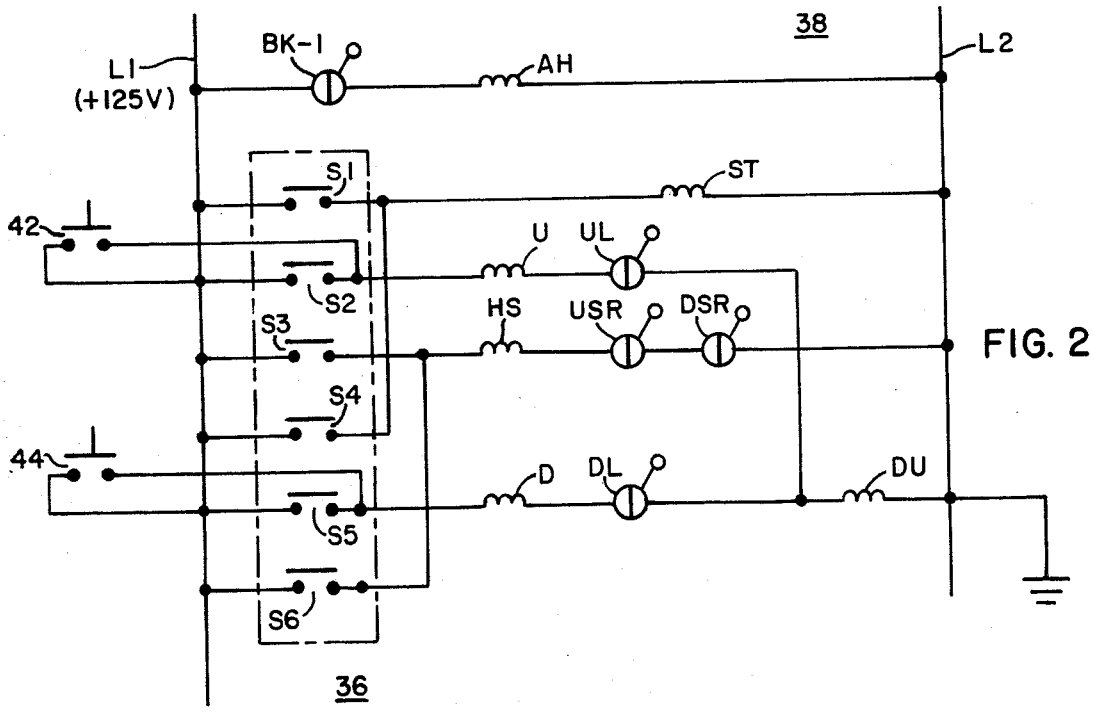
FIG. 2 is a schematic diagram of controls which may be used for certain controls shown in block form in FIG. 1.

FIG. 2 is a schematic diagram illustrating that portion of control 38 shown in FIG. 1 which is required in addition to the normal safety and travel direction circuits. Control 38 includes buses L1 and L2 connected to a source of +125 volts D.C., and to power ground, respectively. An electromagnetic relay AH has its coil connected between buses L1 and L2 via the brake responsive switch BK-1 shown in FIG. 1. Relay AH includes normally closed or break contacts AH-1 and AH-2, the purpose of which will be hereinafter described. When the brake 30 is set, relay AH will be energized and its contacts AH-1 and AH-2 will be open. When the brake coil BK is energized to lift brake shoe 34, switch BK-1 will open to drop relay AH and cause its contacts AH-1 and AH-2 to close.

Control 38 includes the plurality of manually operated switches 36, shown in block form in FIG. 1. Manually operated switches may include six normally open switches S1 through S6, which, as hereinbefore stated, will be assumed to be part of a car switch, but any other suitable switching arrangement may be used. Contacts or switches S1 and S4 are connected in a start circuit for the up and down travel directions, respectively, which circuit includes a start relay ST having a make contact ST-1 disposed to connect the output of the speed pattern generator 40 to the drive machine 26.

Contacts S2 and S5 are connected into existing up and down travel direction circuitry, respectively, associated with the car station mounted in existing control. The existing car control includes up and down direction pushbuttons 42 and 44, respectively, up and down travel limit relays U and D, respectively, upper and lower travel limit switches UL and DL, respectively, and a relay DU. Up pushbutton 42, up relay U, up travel limit switch UL and relay DU are all connected in series between buses L1 and L2. Contact S2 is connected across pushbutton 42. Down pushbutton 44, down relay D, down travel limit switch DL and relay DU are connected in series across buses L1 and L2. Contact S5 is connected across down pushbutton 44

Contacts S3 and S6 are associated with a high speed relay HS. Relay HS is connected between buses L1 and L2 via parallel connected contacts S3 and S6 and upper and lower reset switches USR and DSR, respectively. The reset switches USR and DSR are mounted to drop the high speed relay adjacent to travel limits of the elevator car, to automatically start slowdown at the proper hoistway position relative to the travel limit, notwithstanding the operator maintaining the car switch in a position which calls for maximum speed. The sequencing of the manually operated switches or contacts 36 will be described in detail relative to FIG. 3, when the details of the speed pattern generator 40 are reviewed.

Figure 3:
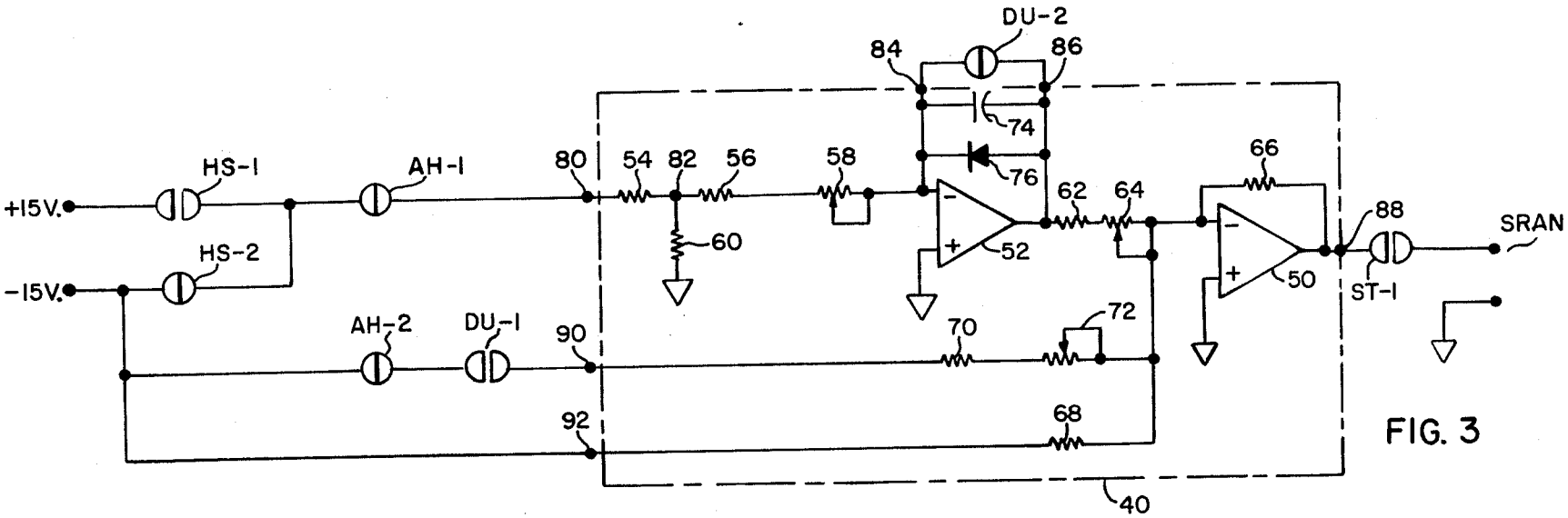
FIG. 3 is a schematic diagram of a speed pattern generator constructed according to the teachings of the invention, which may be used for the speed pattern generator shown in block form in FIG. 1.

FIG. 3 is a schematic diagram of a speed pattern generator 40 constructed according to the teachings of the invention. Speed pattern generator 40 includes first and second operational amplifiers 50 and 52, respectively, which may be conveniently provided as one dual operational amplifier integrated circuit chip (IC). Speed pattern generator 40 further includes a plurality of resistors 54, 56, 58, 60, 62, 64, 66, 68, 70 and 72, a capacitor 74 and a diode 76.

The second operational amplifier 52 is connected to provide an integrating function. An input terminal 80 is connected to its inverting input via serially connected resistors 54, 56 and 58, with the junction 82 between resistors 54 and 56 being connected to signal ground. Resistor 58 may be an adjustable resistor or potentiometer, as illustrated. The non-inverting input of operational amplifier 52 is connected to ground. Capacitor 74 is connected between the output of the operational amplifier and its inverting input. Diode 76 is also connected between the output and the inverting input, with its anode being connected to the output and its cathode to the inverting input. Terminals 84 and 86 are also provided across this feedback circuit, which terminals are connected to break contact DU-2 of relay DU shown in FIG. 2.

The output of operational amplifier 52 is connected to the input of the first operational amplifier 50, via resistors 62 and 64. Resistor 64 is an adjustable resistor.

The first operational amplifier 50 is connected as an inverting amplifier, with its output being connected to its inverting input via resistor 66. Its non-inverting input is connected to ground. Its output is connected to an output terminal 88.

Another input terminal 90 is connected to the inverting input of operational amplifier 50 via resistors 70 and 72, with resistor 72 being an adjustable resistor.

Still another input terminal 92 is connected to the inverting input of operational amplifier 50 via resistor 68.

A positive unidirectional source of potential, such as +15 volts, is connected to input terminal 80 via make contact HS-1 and break contact AH-1 of relays HS and AH, respectively, shown in FIG. 2.

A negative unidirectional source of potential, such as −15 volts, is connected to input terminal 80 via break contact HS-2 and break contact AH-1, of relays HS and AH, respectively.

The negative source of unidirectional potential is also connected to input terminal 90 via break contact AH-2 and make contact DU-1 of relays AH and DU, respectively.

The negative source of unidirectional potential is also connected directly to an input terminal 92.

Output terminal 88 is connected to terminal SRAN via make contact ST-1 of the start relay ST shown in FIG. 2. Speed pattern signal SRAN appears between output terminal SRAN and ground.

The various components of the speed pattern generator 40 may be easily mounted on a single 2″ × 3″ printed circuitboard.

Figure 4:
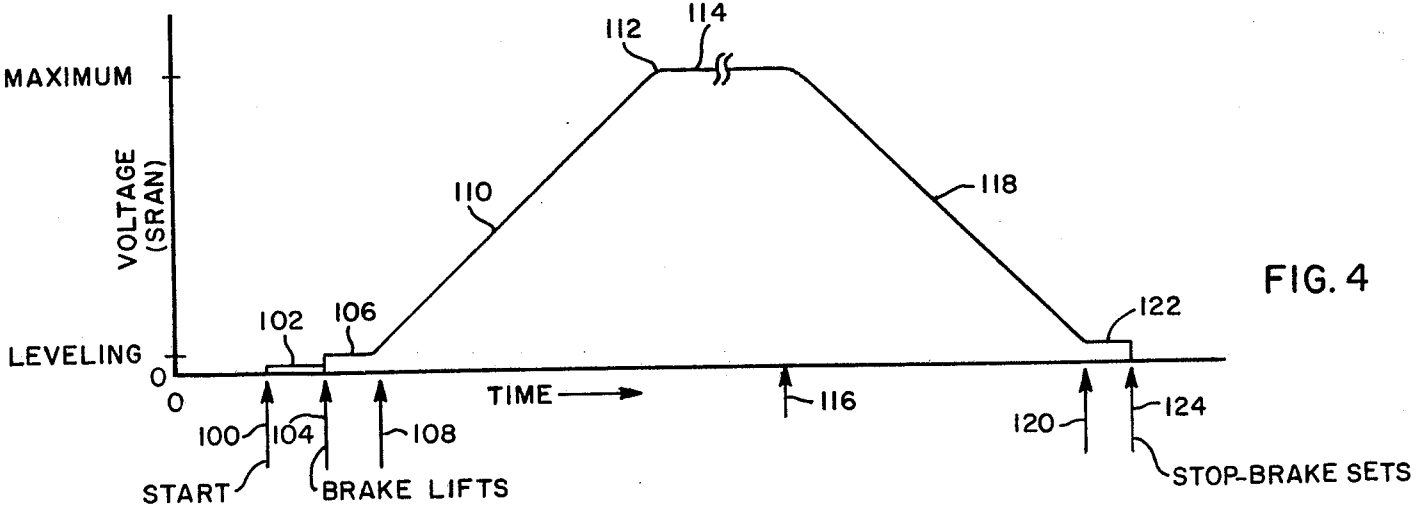
FIG. 4 is a graph illustrating a speed pattern signal developed by the speed pattern generator shown in FIG. 3.

FIG. 4 is a graph which plots the voltage magnitude of the speed pattern signal SRAN versus time, and it will be referred to when describing the operation of the speed pattern generator 40.

The operation of the speed pattern generator 40 is responsive to the manually operated switches 36. Switches S1, S2 and S3 are actuated when the operator wishes to travel upwardly, and switches S4, S5 and S6 are actuated when the operator wishes to travel downwardly.

More specifically, it will be assumed that the elevator car 12 is parked at a landing with its brake 32 set. Brake switch BK-1 will be closed and brake responsive relay AH will be energized. Break contacts AH-1 and AH-2 will both be open, and input terminal 80 will be isolated from both the positive and negative sources of unidirectional potential. Contact DU-1 will be open, so input terminal 90 will be isolated from the negative source of unidirectional potential. Input terminal 92 is directly connected to the negative source of unidirectional potential. Resistor 68 is selected such that the operational amplifier 50 provides a very small positive output voltage, with the magnitude being selected such that the resulting voltage, if applied to the drive control 38 with the brake 30 lifted, would cause the car to move at a speed of only about 6 FPM. The purpose of the circuit which includes input terminal 92 and resistor 68 is to provide an initial bias pattern which prevents the elevator car from momentarily moving opposite to the desired travel direction when the brake 30 is lifted. The bias pattern is always present at the output terminal 88, but the output terminal 88 is only connected to the terminal SRAN when the start relay ST is energized, as contact ST-1 of the start relay ST is connected between output terminal 88 and terminal SRAN.

Assume now that the operator wishes to travel in the upward direction. Movement of the car switch lever from the neutral to a first position in the "up" direction, closes switches S1 and S2. The closing of switch S1 picks up relay ST, and the closing of switch S2 picks up relays U and DU. It should be noted that if the elevator car is already at the upper travel limit, switch UL would be open, preventing the energizing of the up relay U. The up direction relay U includes contacts (not shown) which set the direction circuits for up travel, when relay U picks up. These circuits also enable the brake lift circuit to operate when all safety interlocks are closed. Contacts ST-1 of the start relay ST close when relay ST is energized, to connect the output of operational amplifier 50 to the drive control 38, so that the bias pattern is provided before the brake 30 is lifted, to control the power of the drive machine 26.

Arrow 100 in FIG. 4 marks the point in time when switches S1 and S2 are closed. Curve portion 102 illustrates the bias pattern. When the brake lifts, illustrated by arrow 104, the bias pattern 102 is already causing a small D.C. voltage to be applied to the drive motor, with the polarity of the D.C. drive voltage being that which is necessary to move the elevator car in the upward direction.

When relay DU is energized, it closes its contact DU-1 to enable the branch of the speed pattern generator 40 which includes input terminal 90 and resistors 70 and 72. Contact DU-2 opens to remove the "disable" from operational amplifier 52. When the brake 30 lifts at 104, brake switch BK-1 opens to drop relay AH and close its break contact AH-2. Thus, the negative source of unidirectional potential is applied to the inverting input of operational amplifier 50. The values of resistors 70 and 72 are selected to provide an input voltage magnitude which, when combined with the bias voltage from resistor 68, will provide a speed pattern voltage SRAN having a magnitude which will result in a car speed in the range of about 20 to 30 FPM. This portion of the speed pattern signal is indicated at 106 in FIG. 4. This relatively low magnitude speed pattern signal provides a smooth start for the elevator car, and it also provides a suitable landing speed. Resistor 72 is set to select the specific pattern voltage and thus the specific desired landing speed in the landing speed range.

Once the elevator car moves away from the floor, the operator advances the car switch lever to a second or high speed position which closes switch S3. The closing of switch S3 picks up the high speed relay HS. Contact HS-1 closes and contact HS-2 opens, to apply the positive source of unidirectional potential to input terminal 80. The closing of switch S3 is illustrated by arrow 108 in FIG. 4.

The output voltage of operational amplifier 52 starts to go negative in a linear manner, with the slope of the ramp, and thus the rate of acceleration, being selected by resistor 58. The negative going output voltage from operational amplifier 52 is applied to the inverting input of operational amplifier 50, and operational amplifier 50 provides a positive going ramp indicated by curve portion 110 in FIG. 4. The output of operational amplifier 52 continues to go negative until operational amplifier 52 saturates at 112 and the car then travels at a constant speed indicated by curve portion 114. The maximum car speed is selected by resistor 64.

When the operator desires to initate slowdown to stop at a floor, the car switch lever is moved from the high speed position to open switch S3 and drop the high speed relay HS. The opening of switch S3 is indicated by arrow 116 in FIG. 4. When relay HS drops, contact HS-1 opens and contact HS-2 closes to apply the negative source of unidirectional voltage to the inverting input of operational amplifier 52. This causes the output of operational amplifier 52 to increase linearly in a positive going direction. Diode 76 prevents the output of the operational amplifier 52 from actually providing a voltage having a positive polarity. The positive going output voltage is applied to operational amplifier 50 which provides the negative going ramp or curve portion 118 shown in FIG. 4.

When the speed pattern portion 118 reaches leveling speed, indicated by arrow 120, it remains at this magnitude until floor level is reached. The landing speed portion of the speed pattern signal SRAN is illustrated at 122 in FIG. 4. When the floor level is reached, the operator moves the car switch lever to the neutral position, which opens switches S1 and S2 to drop the start relay ST and relays U and DU. Contact ST-1 opens to isolate the output of operational amplifier 50 from terminal SRAN, and brake 30 is set to hold the car. The return of the car switch lever to neutral is indicated by arrow 124 in FIG. 4.

The operation of the speed pattern generator 40 is similar for the down direction, with switches S4, S5 and S6 being actuated as hereinbefore described relative to switches S1, S2 and S3, respectively.

In summary, there has been disclosed a new and improved solid state speed pattern generator which provides all of the functions necessary for control of a construction elevator car. The speed pattern generator is very small, being mountable on a very small printed circuitboard, and the cost of its components, as well as the cost to assemble the components, is minimal. Further, by using an integrating function provided by an operational amplifier, the acceleration and deceleration portions of the speed pattern are linear, instead of exponential.

I claim as my invention:

1. A speed pattern generator for manually operated construction elevator car controls, comprising:

amplifier means having an input and an output, said amplifier means including a first operational amplifier, integrating means having an input and an output, said integrating means including a second operational amplifier, means connecting the output of said integrating means to the input of said amplifier means, first pattern circuit means connected to the input of said amplifier means, second pattern circuit means connected to the input of said integrating means, and control means for activating and deactivating said first and second pattern circuit means in a predetermined sequence to provide a speed pattern signal at the output of said amplifier means.

2. The speed pattern generator of claim 1 including third pattern circuit means connected to the input of the amplifier means, and wherein the control means activates and deactivates the first, second and third pattern circuit means in a predetermined sequence.

3. The speed pattern generator of claim 2 including an elevator car, drive means for said elevator car, brake means, and means responsive to the condition of said brake means, with said brake responsive means being in a first condition when the brake means is set, and in a second condition when it is lifted, and wherein the control means activates only the third pattern circuit means when said brake responsive means is in its first condition, with said first pattern circuit means being enabled when said brake responsive means switches to its second condition.

4. The speed pattern generator of claim 1 including an elevator car, drive means for said elevator car, brake means associated with said drive means, and means responsive to the condition of said brake means, with said brake responsive means being in a first condition when the brake means is set, and in a second condition when it is lifted, and wherein the first pattern circuit means is enabled when the brake responsive means is in its second condition.

5. The speed pattern generator of claim 1 including an elevator car, drive means for said elevator car, brake means associated with said drive means, and brake responsive means, said brake responsive means being in a first condition when said brake means is set, and in a second condition when said brake means is lifted, with the first and second pattern circuit means being disabled when the brake responsive means is in its first condition, the first and second pattern circuit means being enabled when the brake responsive means is in its second condition.

6. The speed pattern generator of claim 5 including third pattern circuit means connected to the input of the amplifier means, with the control means selectively activating and deactivating the first, second and third pattern circuit means in a predetermined sequence, and wherein the control means activates the third pattern circuit without regard to the condition of the brake responsive means.

7. The speed pattern generator of claim 1 wherein the second operational amplifier includes a feedback capacitor, and a diode connected across said feedback capacitor poled to enable the second operational amplifier to build up an output voltage of a single selected polarity.

* * * * *